US006964538B1

(12) United States Patent
Owen

(10) Patent No.: US 6,964,538 B1
(45) Date of Patent: Nov. 15, 2005

(54) CORNER CLIP DOCUMENT HOLDER

(75) Inventor: Joshua K. Owen, Philadelphia, PA (US)

(73) Assignee: Paris Business Products, Inc., Westampton, NJ (US)

( * ) Notice: Subject to any disclaimer, the term of this patent is extended or adjusted under 35 U.S.C. 154(b) by 0 days.

(21) Appl. No.: 10/784,317

(22) Filed: Feb. 20, 2004

(51) Int. Cl.[7] ..... B42F 13/00
(52) U.S. Cl. ..... 402/73; 24/67 R; 24/67.11; 40/778; 402/80 P
(58) Field of Search ..... 402/73, 80 R, 402/80 P; 24/67 R, 67.11, 67 CF; 40/778, 40/782

(56) References Cited

U.S. PATENT DOCUMENTS 5,937,485 A * 8/1999 Dittmer ..... 24/67 R

FOREIGN PATENT DOCUMENTS

EP 1 074 401 A1 2/2001
WO WO 98/24639 * 6/1998

* cited by examiner

*Primary Examiner*—Monica S. Carter
(74) *Attorney, Agent, or Firm*—Norman E. Lehrer

(57) ABSTRACT

The document holder essentially includes a front, generally flat, rectangular cover and a back, generally flat, rectangular cover. The covers may be transparent and are joined at one corner. This may be the upper left hand corner. A clip is pivotably mounted to both the front and back covers at the corner and the clip is pivotable from an operative position wherein the papers are held between the covers by the clip and an inoperative position wherein the papers may be released from the clip. The clip is mounted to the covers via a rivet. The covers are scored adjacent the corner so that the covers may be opened as necessary and lay flat. The holder is also reversible so that it can be arranged either horizontally of vertically with the clip always in the upper left corner.

4 Claims, 2 Drawing Sheets

CORNER CLIP DOCUMENT HOLDER

The present invention is directed toward a document holder and more particularly, toward a document holder with a pivotable clip that holds papers only at a corner so that they can be easily folded to an open position and which allows papers to be added easily or that allows papers held within the holder to be easily removed as needed.

There are many types of document holders or report covers available for holding and protecting a plurality of papers. The most common type of cover includes a folded plastic cover which is usually clear or translucent. Located along the folded side is a clip or slide grip that removably slides onto the side. The papers contained within the cover are held in place by the clip.

Many times documents or papers are placed within a plastic report cover and are then used to make a presentation, hand in as an assignment, project, or report, or the like. A problem with these report covers is that the papers cannot be removed easily from the cover because the cover includes the binder clip extending along the folded edge of the cover. The binder clip keeps the papers in place; however, it is almost impossible to remove a single piece of paper from the cover without completely removing the clip and dislodging most, if not all, of the papers contained therein. Also, if there are many papers within the cover, the binder clip may be more difficult to remove. Another problem is that the cover will not lay flat when opened and placed on a level surface, such as a desk, podium, or lectern.

Some of the problems associated with the prior binder clips are eliminated by the use of corner clips such as shown in the Avery Dennison European Application No. EP 1,074,401 A1 published on Feb. 7, 2001. The Avery corner clip, however, is difficult to manufacture as the plastic cover must be scored and folded after the metal clip is riveted in place. Furthermore, the Avery clip may tear from the plastic cover as it is secured through only the back sheet of plastic. Even further, the Avery clip is not reversible. That is, there is a distinct front and back and the device must be used in that manner. Accordingly, separate landscape and portrait clips and covers must be purchased.

Therefore, a need exists in the field for a reversible document holder that does not include the deficiencies of the prior art discussed above and which allows papers to be removed from within the cover without disturbing the rest of the papers contained within the cover as well as a cover that will open easily and will remain open if necessary.

SUMMARY OF THE INVENTION

The present invention is designed to overcome the deficiencies of the prior art discussed above. It is an object of the present invention to provide a report cover that allows papers to be easily added or the papers contained therein to be easily removed.

It is another object of the present invention to provide a report cover that can be easily opened and will remain open as needed.

It is a further object of the present invention to provide a report cover that is reversible thereby allowing the same to be used in either horizontally (landscape) or vertically (portrait).

In accordance with the illustrative embodiments demonstrating features and advantages of the present invention, there is provided a document holder that essentially includes a front, generally flat, rectangular cover and a back, generally flat, rectangular cover. The covers may be transparent or translucent and are joined at one corner. This may be the upper left hand corner. A clip is pivotably mounted to both the front and back covers at the corner and the clip is pivotable from an operative position wherein the papers are held between the covers by the clip and an inoperative position wherein the papers may be released from the clip. The clip is mounted to the covers via a rivet other similar fastening means known in the art. The covers are scored adjacent the corner so that the covers may be opened as necessary and lay flat. Because the covers are essentially symmetrical front-to-back, cover and the papers contained therein can be arranged horizontally, i.e. in landscape mode, or vertically, i.e. in portrait mode.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings a form which is presently preferred; it being understood that the invention is not intended to be limited to the precise arrangements and instrumentalities shown.

DETAILED DESCRIPTION OF THE PREFERRED EMBODIMENTS

Figure 1:
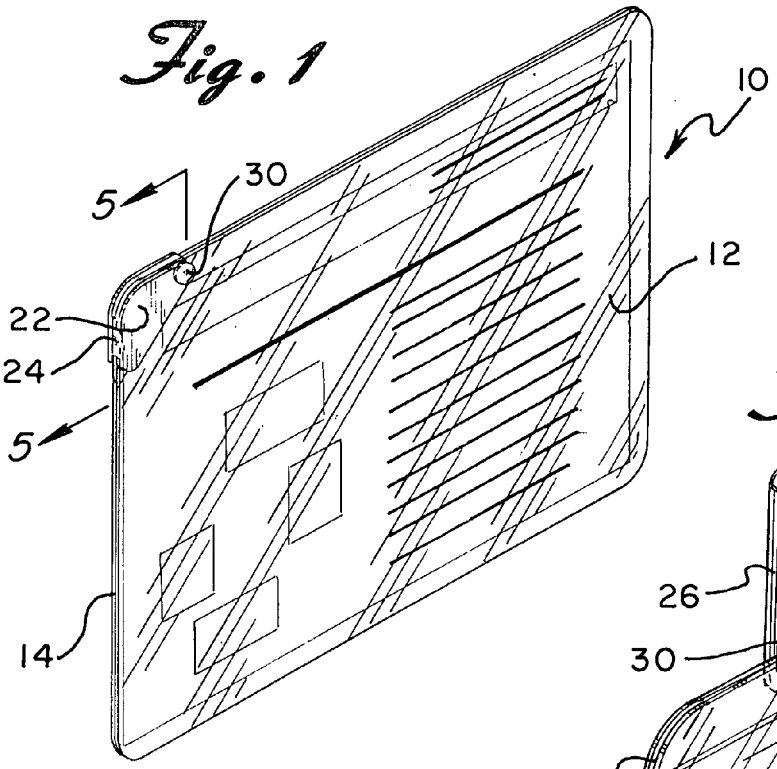
FIG. 1 is a front perspective view of the corner clip and document holder of the present invention showing the same arranged horizontally.

Referring now to the drawings in detail wherein like reference numerals have been used throughout the various figures to designate like elements, there is shown in FIG. 1 a document holder constructed in accordance with the principles of the present invention and designated generally as 10.

Figure 3:
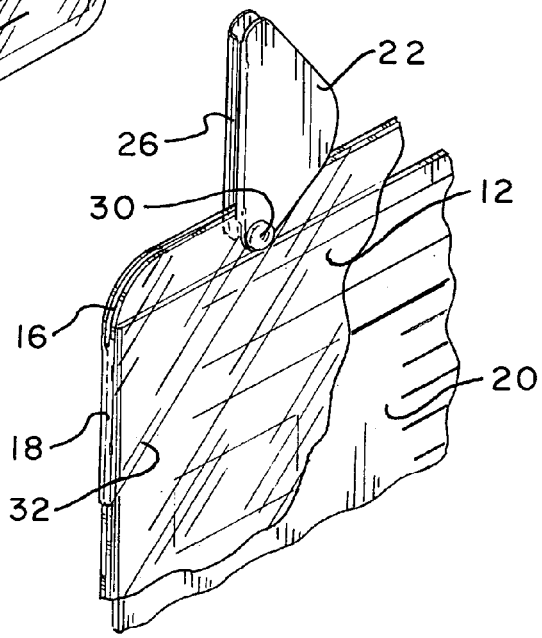
FIG. 3 illustrates the clip of the present invention in an inoperative position.

The document holder of the present invention essentially includes a front, generally flat, elongated rectangular cover 12 and a back, generally flat, elongated rectangular cover 14. The covers 12 and 14 are preferably transparent or translucent. The covers 12 and 14 are joined at one corner 16. This may be the upper left hand corner of the covers 12 and 14. The area 18 joining the covers 12 and 14 does not join the covers 12 and 14 entirely at the corner 16. (See FIG. 3.) That is, only a small portion of the edges of the covers 12 and 14 are joined.

Preferably, the front and back covers 12 and 14 are cut from a single sheet of plastic. To from the front and back covers, the entire perimeters are cut except for the small connecting area 18 located at the edge of the covers adjacent the upper left corner. The uncut connecting portion 18 can be either on the side or the top of the front and back covers 12 and 14 but obviously not both. After the front and back covers are cut from a sheet of plastic, the two are folded over each other utilizing the connecting area 18 as a hinge.

Figure 6:
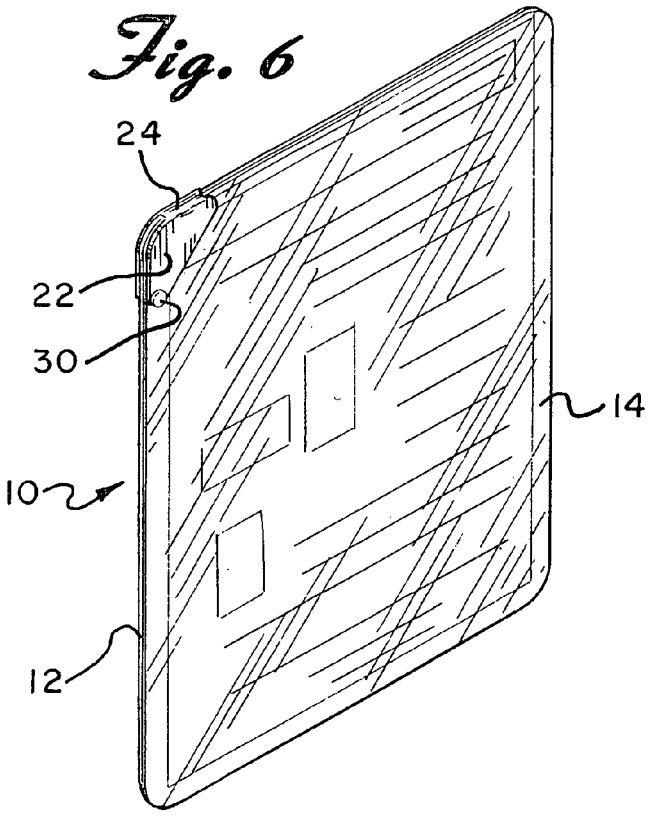
FIG. 6 is a rear perspective view of the present invention illustrating how the same may be arranged in a vertical or portrait position.

One or more sheets of paper 20 may be held between the front and back covers 12 and 14, respectively, as will be described in greater detail below. The covers are adapted to substantially enclose the one or more sheets of paper therebetween. Furthermore, and as will become apparent, the papers 20 can be arranged either horizontally as shown in FIG. 1 or vertically as shown in FIG. 6.

Figure 2:
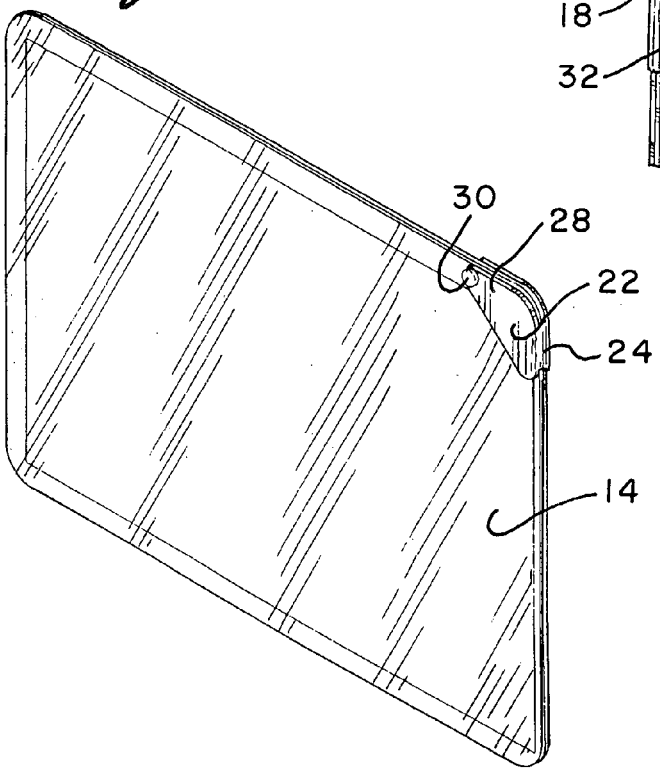
FIG. 2 is a rear perspective view of the invention.

A triangularly shaped clip 22, preferably made of metal, is pivotably mounted to both the front cover 12 and the back cover 14 at the corner 16. The clip 22 is pivotable from an operative position where the clip 22 covers the corner 16 of the covers 12 and 14 and an inoperative position where the clip 22 is pivoted away from the corner 16, thereby exposing the corner 16. (See FIGS. 2 and 3.) The size of the clip 22 is configured so that when it is in the closed or operative position, it substantially totally overlies the connecting area 18. That is, the length of the legs of the triangle forming the clip 22 is long enough to cover the connecting area 18. Said another way, no part of the front cover 12 is connected to the back cover 14 outside of the area encompassed by the clip 22.

The clip is preferably formed from a single piece of metal that is folded over itself about the living hinge 24 which forms the left side or one leg of the triangle forming the clip. The front and back of the clip are spaced slightly apart, thereby forming an opening or jaw 26 along the hypotenuse of the triangle. Preferable, the free metal edges forming the hypotenuse are folded under to form a smooth spring like opening of jaw 26.

Figure 4:
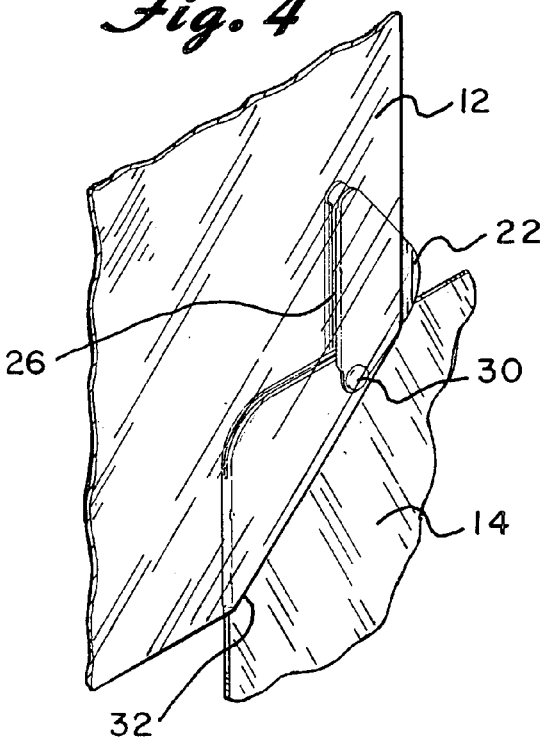
FIG. 4 is a view similar to FIG. 3 illustrating the front cover of the present invention in an open position.
Figure 5:
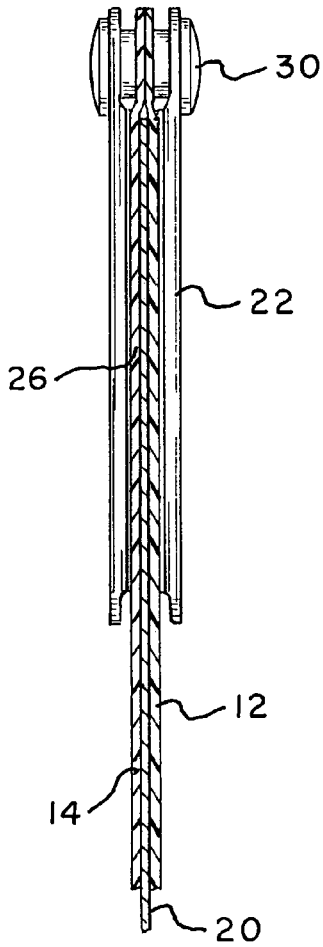
FIG. 5 is a cross-sectional view taken through line 5—5 of FIG. 1.

At the corner 28 opposite the hinge 24, the clip 22 is mounted to the covers 12 and 14 via a rivet 30 or other similar fastening means known in the art. (See FIG. 5.) Preferably, the covers 12 and 14 are scored adjacent the corner 16, below the clip 22 when the clip 22 is in its operative position. This is shown, for example, at scored line 32 on the front cover 12. (See FIG. 4.)

In order to use the device in the horizontal or landscape orientation, the clip 22 is pivoted in an upward direction to its inoperative position, away from the covers 12 and 14. The front cover 12 is opened. The diagonal scored line 32 allows the front cover 12 to remain open and lay flat. (See FIG. 4.) Papers may be inserted between the covers 12 and 14 so that a corner of the papers fits within the corner 16. The front cover 12 may then be closed and the clip 22 may be pivoted in a downward direction to its operative position, covering the corner 16 and the area 18 where the covers 12 and 14 are joined. The clip 22 holds the papers in place. If papers need to be removed from the device, the clip 22 is pivoted to an inoperative position. The front cover 12 is opened so that the papers may be removed.

To use the device 10 in the vertical or portrait orientation, the entire device is first turned over so that the back 14 becomes the front. The device is the rotated so that the clip 22 is again at the upper left corner. The clip 22 can then be moved into its open or inoperative position by pivoting it downwardly about the pivot formed by the rivet 30. The holder is then used in the same manner as described above.

The present invention may be embodied in other specific forms without departing from the spirit or essential attributes thereof and accordingly, reference should be made to the appended claims rather than the foregoing specification as indicating the scope of the invention.

I claim:

1. A document holder for holding one or more sheets of paper comprising:

a front, generally flat, elongated rectangular cover and a back, generally flat, elongated rectangular cover, said covers being formed of a single sheet of material and joined together by only a portion of said material adjacent one corner of said front and back covers, said covers being adapted to substantially enclose the one or more sheets of paper therebetween and a substantially triangularly shaped clip pivotably mounted to both of said front and back covers adjacent said corner, said clip being pivotable from an operative position wherein the papers are held between said covers by said clip and an inoperative position wherein the papers may be released from said clip, said clip covering said portion of said material when in said operative position.

2. The document holder of claim 1 wherein said front and back covers are diagonally scored adjacent said corner to allow said covers to open and lie flat.

3. The document holder of claim 1 wherein said covers are transparent.

4. The document holder of claim 1 wherein said covers are translucent.

* * * * *